US006536200B1

(12) United States Patent
Schwartz

(10) Patent No.: US 6,536,200 B1
(45) Date of Patent: Mar. 25, 2003

(54) METHOD OF MAKING A WRAPPED COMPOSITE COLOR BLENDED ALTERNATING COLOR YARN

(75) Inventor: Nathan G. Schwartz, Newtown Square, PA (US)

(73) Assignee: Textured Yarn Co., Inc., PA (US)

( * ) Notice: Subject to any disclaimer, the term of this patent is extended or adjusted under 35 U.S.C. 154(b) by 281 days.

(21) Appl. No.: 09/690,177

(22) Filed: Oct. 17, 2000

(51) Int. Cl.[7] ..... D01H 5/32
(52) U.S. Cl. ..... 57/317; 57/6
(58) Field of Search ..... 57/3, 6, 200, 206–208, 57/210, 243–245; 28/271; 428/364

(56) References Cited

U.S. PATENT DOCUMENTS

| | | | | |
|---|---|---|---|---|
| 320,344 | A | * | 6/1885 | Fuyat |
| 3,035,404 | A | * | 5/1962 | Roscoe |
| 3,086,347 | A | * | 4/1963 | Keen et al. |
| 3,983,609 | A | | 10/1976 | Pike |
| 4,383,403 | A | * | 5/1983 | Nakayama et al. |
| 4,542,619 | A | * | 9/1985 | Schwartz |
| 4,644,620 | A | | 2/1987 | Maeda |
| 4,729,151 | A | | 3/1988 | Runyon et al. |
| 5,148,586 | A | | 9/1992 | Coons, III |
| 5,251,363 | A | | 10/1993 | Gerhards et al. |
| 5,590,447 | A | | 1/1997 | Goineau |
| 5,613,285 | A | | 3/1997 | Chester et al. |
| 5,632,139 | A | | 5/1997 | Tate |
| 5,996,328 | A | | 12/1999 | King et al. |
| 6,482,512 | B1 | * | 11/2002 | Schwartz |

* cited by examiner

*Primary Examiner*—John J. Calvert
*Assistant Examiner*—Shaun R Hurley
(74) *Attorney, Agent, or Firm*—Schnader Harrison Segal & Lewis LLP

(57) ABSTRACT

A composite textured helically wrapped multi-filament yarn, made up of two or more continuous filament textured yarns, each of which is of different color or dyeability from the other, each yarn being pigmented in a melt-spinning process, pre-dyed, or undyed with different dye affinities which are subsequently dyed, by wrapping the colored textured yarns into a composite yarn having repeated color change alternating cycles along its length, and the alternating cycles having between them a lengthwise color difference of about 15–97% or more on the circumferential surface of the yarn in either the red, green or blue primary colors, as measured by spectral analysis, between immediately adjacent lengths thereof, and each adjacent color length being between about 4 inches to 144 inches.

5 Claims, 3 Drawing Sheets

METHOD OF MAKING A WRAPPED COMPOSITE COLOR BLENDED ALTERNATING COLOR YARN

BACKGROUND OF THE INVENTION

Figure 1:
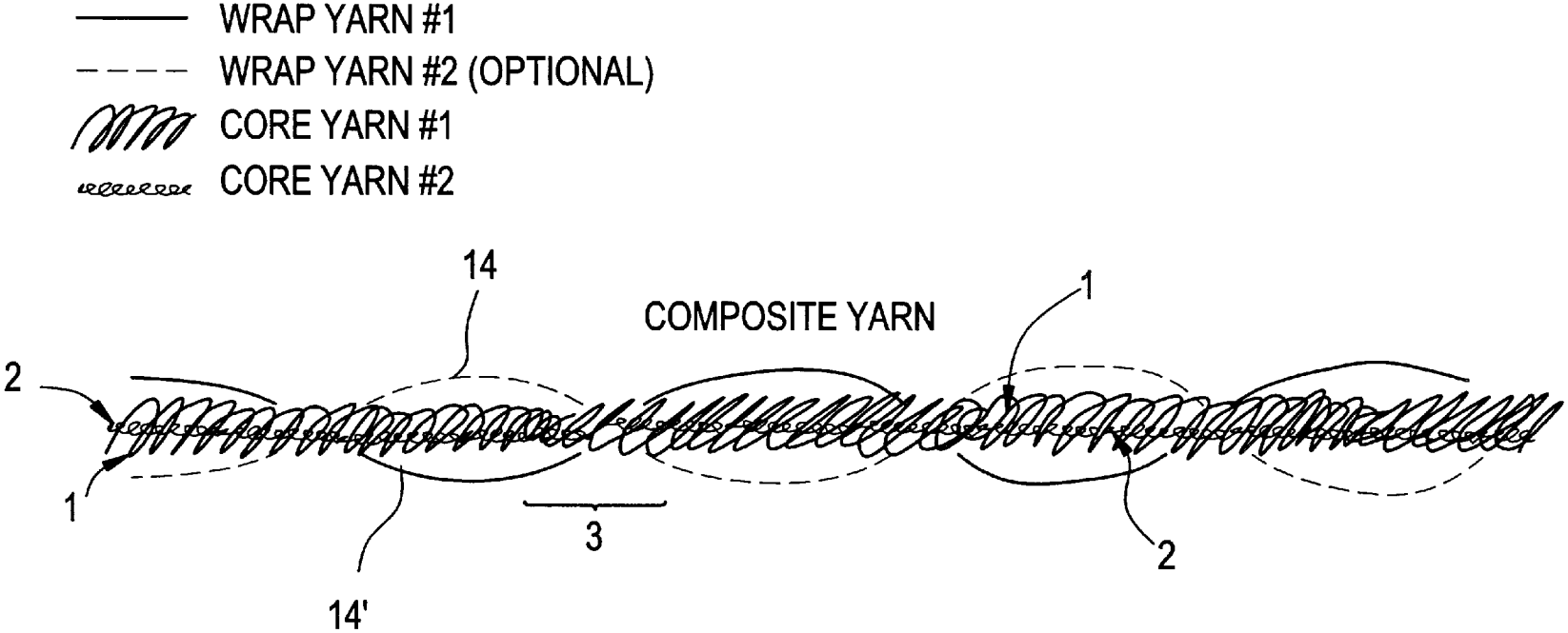

This invention relates to a method of making composite textured multi-filament yarn. It particularly relates to a textured composite yarn comprising at least two texturized feed yarns having at least two colors or color dyeabilities, all referred to herein as colors, wherein the composite yarn has alternating lengthwise sections exhibiting a major color difference from section to section in either the red, green or blue primary colors, as measured by spectral analysis of immediately adjacent lengths of the composite yarn.

The invention further relates to a composite textured multi-filament yarn wherein the yarn is wrapped by a wrapper yarn so that the multiple filaments are substantially squeezed together along their lengths, forming adjacent sections of filaments per meter of about five or more, measured along the composite yarn length.

A novel composite yarn is produced from two or more pre-colored or pigmented continuous filament textured multi-filament yarns, substantially helically wrapped by one or more wrapper yarns. The novel composite yarn is distinguished in appearance by displaying to the observer a sharply repeating color change along the length of the yarn. It demonstrates a more visually distinctive change of color over a greater composite yarn length than has heretofore been obtained in a composite multi-ply yarn assembled from a plurality of single continuously colored textured yarns.

Textured continuous filament manmade yarns can be single colored yarns or multi-color yarns. Multi-color textured continuous filament yarns are usually produced by either space-dyeing a single textured yarn by applying dyes of different colors along the length of the yarn, or by combining single color dyed or pigmented textured yarns.

Wrapped composite yarns made by wrapping separate, discreet, or individual textured color yarns are limited in their ability to significantly alter the color of the composite yarn over any meaningful length of the yarn product, as can be done by space-dyeing. Such yarns are characterized by relatively short lengthwise changes of color, as it has not heretofore been possible to change color for any significant length, from one or more of the constituent colors still present in the composite yarn. Therefore, the visual effect of existing multi-color yarns made from separate colored yarns has been to have all of the constituent colors more or less present or visible on the surface of the yarn over limited lengthwise distances of only a maximum of about two inches or so.

SUMMARY OF THE INVENTION

In this invention a composite textured wrapped yarn is provided consisting of two or more pre-colored individual textured yarns, where the overall color appearance of the composite yarn changes its color in repeating cycles along its length by a large and easily detectable percentage in the red, green or blue part of the spectrum. The color change is much more than has heretofore been produced with a blend of pre-colored textured continuous filament constituent yarns. The composite novel yarn of this invention more closely resembles traditional "space-dyed" textured filament yarns where adjacent lengths of the finished yarn can exhibit longer and larger color changes, because there the color changes are achieved by applying various dyes locally to the yarn at selected places along its length. This invention now avoids the expense and complications of the space-dyeing process.

This invention creates a wrapped yarn of more contrasting lengthwise color changes. According to this invention, at least two feed yarns are provided. They are made of pre-colored textured continuous filaments, and according to this invention by alternately or selectively moving to the yarn surface one or more colored yarn input components, while submerging another colored yarn input component, and periodically reversing these surface and submerged positions, as schematically shown in FIG. 1. This is done by:

(1) surfacing one textured yarn to the visible circumferential surface of a subsequently wrapped composite yarn while mostly submerging within the composite bundle the accompanying textured yarn having one or more contrasting colors;

(2) then reversing the process and surfacing the mostly submerged interior yarn to the visible circumferential surface of the subsequently wrapped yarn while mostly submerging within the interior of the composite yarn the formerly visible exterior yarn, and continuing to alternate the surfacing and submerging reversals indefinitely while squeezing both of the colored textured yarns together by the wrapping process. A heather-like transition zone of nearly equal amounts of each color is created at those locations along the length of the resulting composite yarn as the colored yarns exchange places between submerged and surface locations inside or on the wrapped composite yarn product. Each such transition zone appears as a gradually changing blend of the two colors as they exchange interior and exterior places, switching from a more submerged position to a more visible position on the wrapped composite yarn circumference, or vice versa.

DRAWINGS

Figure 2:
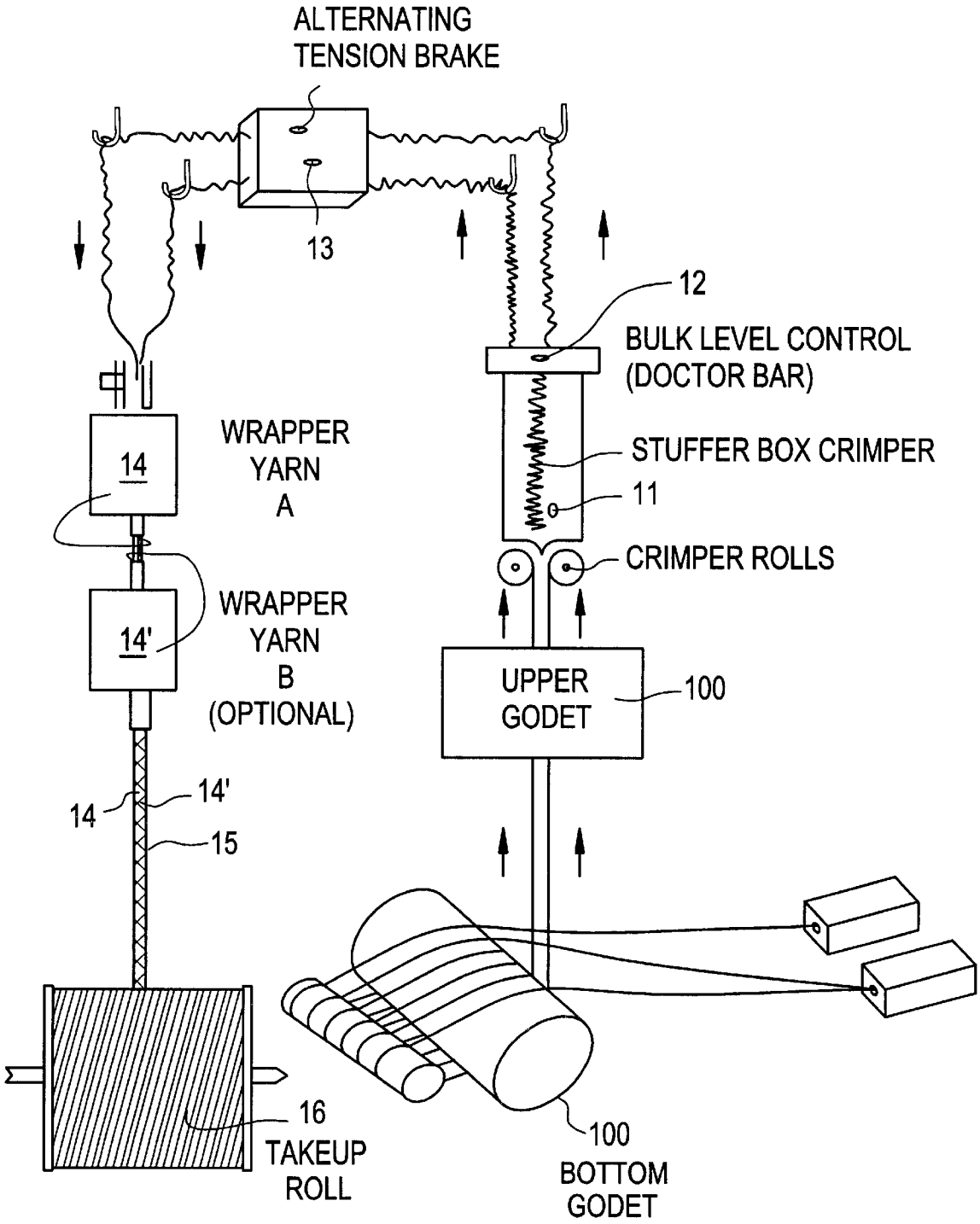
Figure 3:
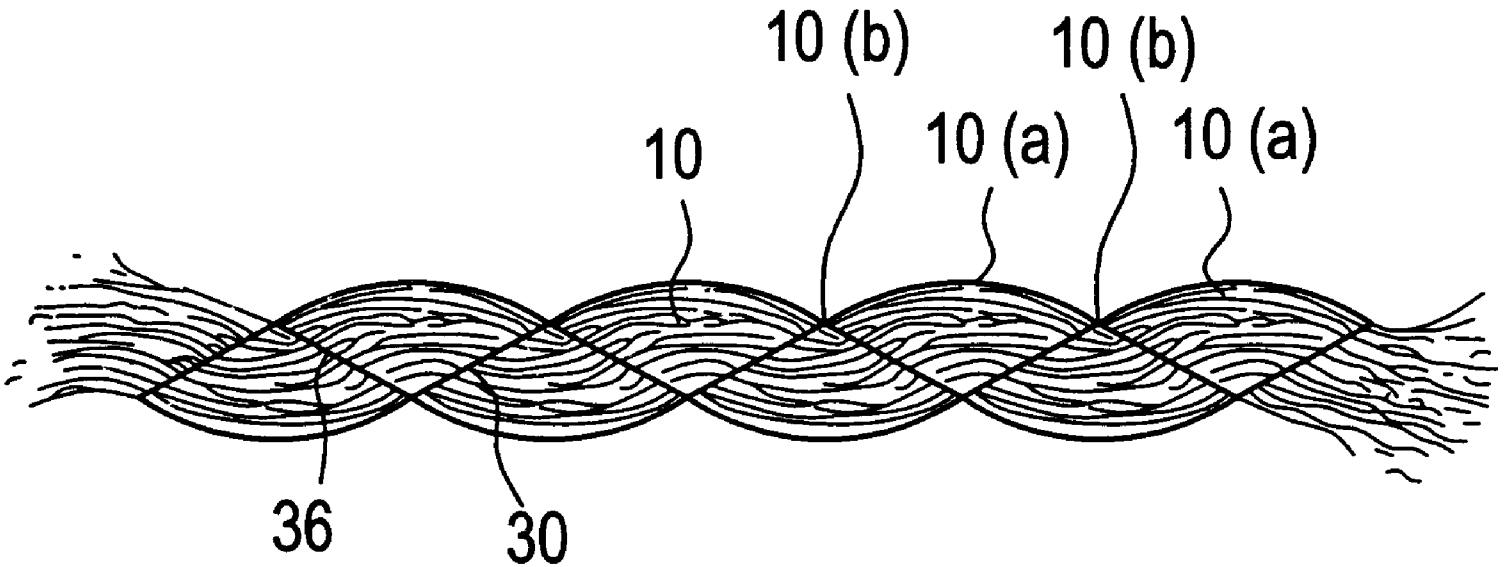

In the drawings:

FIG. 1 is a schematic view of a wrapped composite yarn in accordance with this invention, FIG. 2 is an exploded view of machine components useful in making the yarn, and FIG. 3 is a detail view of a method of wrapping textured yarns in accordance with this invention.

In the FIG. 1 drawing, colored textured feed yarn 2 is shown at the left in a submerged mode, with different colored textured feed yarn 1 at or near the composite yarn surface. The color of yarn 1 is dominant to the eye of the observer. As the yarn 2 approaches the composite yarn surface and the yarn 1 approaches the submerged position, heather-like color transitions occur in the transition zone 3. When the yarn 2 reaches the composite yarn surface or comes close to it as shown at the right in the drawing, the yarn 2 color predominates and the yarn 2 mostly obscures the color of the yarn 1.

There are many ways to shift the feed yarns back and forth between submerged and exposed positions. A preferred method comprises alternately tensioning one feed yarn while relaxing the tension on the other feed yarn, and vice versa, continuously repeated. The submerged and exposed portions are held in place by the wrapper yarn but the presence of the wrapper yarn does not inhibit the transitions between submerged and exposed modes under the influence of changing tensions.

EXAMPLE

In a preferred texturing machine, manufactured by Textured Yarn Co., Inc. of Kennett Square, Pa., portions of which are shown in FIG. 2, two or more colors of pigmented continuous multi-filament polypropylene yarn were placed in a creel and separately fed around a heated godet(s) 100, 1000 and fed into a stuffer-box crimping machine 11 (FIG. 2). Upon exit from the crimper's doctor bar 12, the two separate, pre-colored yarn bundles were alternately subjected to tension and relaxation, with one yarn tensioned and the other relaxed, through a (programmable) tension device or gate 13, FIG. 2. After passing the tension device 13, with each yarn at a different tension, the yarns were fed into one or more hollow spindles 14, 14" which combined the different colored and differently tensioned feed yarns into one finished composite yarn. The final composite wrapped yarn 15 was wound on a conventional take-up tube 16.

In the above described procedure, the pre-colored continuous filament textured yarn that was subjected to higher tension by the tension device or gate 13 was submerged to some degree within the composite wrapped yarn, at least partly because of higher applied tension. The pre-colored continuous filament textured yarn that was subjected to lower tension migrated more to the visible surface of the composite yarn and its color accordingly dominated the appearance of the composite yarn at that point. In the continued operation of the apparatus of FIG. 2, the repeated surfacing and submerging of the respective colors was repeated by repeating tension changes of each textured yarn many times along the length of the resulting composite yarn 15.

The degree of achieved color contrast of at least one primary color, between adjacent lengths of the final composite yarn 15, is a function of a number of factors including, but not limited to, the amount of tension placed on each selected pre-colored yarn exiting the crimping doctor bar, the amount of bulk or crimp in the yarn created by the texturing or crimping process, the speed of the process, the total denier and denier per filament of the original input materials, and the squeezing force applied by the one or more wrapper yarns. One excellent wrapping process is shown and in the Techniservice, Inc. U.S. Pat. No. 4,542, 619, the disclosure of which is incorporated herein by reference. A resulting yarn is shown in FIG. 3 herein having a core yarn 10 made up of color texture feed yarn 10*a*, 10*b* and wrapping yarns 30, 36.

Many optical tests were conducted as heretofore described to compare composite yarns of this invention with various trade yarns. The results of the tests are set forth below.

| TRADE YARNS | Primary Red | Red % change in adjacent areas | Primary Green | Green % change in adjacent areas | Primary Blue | Blue % change in adjacent areas |
|---|---|---|---|---|---|---|
| DuPont Color Link Yarn 8" adjacent lengths | | | | | | |
| Sample 1 | 172 | | 149 | | 123 | |
| Sample 2 | 172 | 0.0 | 149 | 0.0 | 123 | 0.0 |
| Sample 3 | 172 | 0.0 | 152 | 2.0 | 126 | 2.4 |

| INVENTION WRAP YARN | Primary Red | Red % change in adjacent areas | Primary Green | Green % change in adjacent areas | Primary Blue | Blue % change in adjacent areas |
|---|---|---|---|---|---|---|
| Vari-Color c.18" adjacent color lengths | | | | | | |
| Sample 1 | 29 | | 37 | | 43 | |
| Sample 2 | 57 | 97.0 | 84 | 127.0 | 93 | 116.0 |

Generally speaking, in accordance with this invention, a higher alternating tension of the exiting crimped yarn from the stuffer box, a higher bulk in the crimped yarn, a lower process speed, and relatively more wrapper nodes per unit length in the finished composite yarn tended to produce sharper degrees of color contrast and/or shorter lengths of such contrasting sections in the finished wrapped composite yarn. Generally speaking, lower alternating tension of the exiting crimped yarn, lower bulk in the crimped yarn, higher process speed, and relatively fewer wrapper nodes per unit length in the finished composite yarn tended to produce lower degrees of color contrast and/or longer lengths of such contrasting sections in the composite yarn.

Tests were conducted which sharply differentiate this invention from other textured multi-filament, multi-color composite yarns made from single continuous pigmented or pre-colored yarns. According to the tests:

a) the subject wrapped yarn was pre-twisted with sufficient twist to expose from one side or viewpoint some portion of the total observable surface of the yarn when the subject yarn is stretched to a length of approximately ½ inch.

b) the composite pre-twisted wrapped yarn above was continuously wrapped around a narrow flat pallet in such a manner that each succeeding wrap is nested close to or up against its neighbors.

c) two adjacent areas exhibiting a marked color change were subjected to color analysis for their red, green and blue primary color content. In the present case, the flat colored yarn pallet colors were scanned, ignoring the wrapper yarn(s) and then imported into Adobe Photoshop 5.5 on an IBM-based PC computer. Adjacent areas of the yarn pallet were circumscribed by the software, and the histogram feature of the software gave the numerical mean red, green and blue primary color values of the texturized yarns on a scale from 0 to 255, along with the median value, standard deviation, and luminosity.

d) each adjacent area color analyzed was unwound from the pallet, extended, and measured to define its length, or its length was determined from the pallet itself by counting the number of windings and the known dimensions of the pallet in a given area.

By such test means, the present yarn invention was discovered, as shown in the Table herein, to have a significantly greater change in either the red, green, or blue primary color than corresponding color in other multi-filament textured yarns made from continuously colored strands and not space-dyed. Percentage changes in one primary color ranging from a 15% to 95% were measured as shown in the Table for the many measured samples of the composite yarns according to the present invention. A variety of other multi-color entangled yarns made from two or more continuously colored yarns generally known to be available in the trade tested in the range of only 2% to 12% for change in either the red, green or primary blue colors.

Although FIG. 2 shows a stuffer crimper, the feed yarns can be texturized in any commercially acceptable way, such as false twisting, fluid airjet texturizing, knit-deknit or the like. Although each textured yarn is highly preferably of a single color, multiple colors may be used if desired, but may result in lower contrast results from length to adjacent length.

I claim:

1. A process for making a composite textured and wrapped composite multi-filament yarn, comprising the steps of combining two or more continuous filament textured yarns, each of which is of different color or dyeability from the other, said textured yarns being combined into said composite yarn possessing repeated color change alternating cycles along its length, and said alternating cycles having between them a lengthwise color difference of about 15–95% or more in either the red, green or blue primary color, as measured by spectral analysis, between immediately adjacent lengths thereof, substantially helically wrapping an outer wrapper yarn around said textured yarns to squeeze them together to each other and, while thus wrapping around said yarns and preserving the intermittently submerging of one of said colored textured yarns within said composite yarn while preserving of the surfacing the other of said colored textured yarns to a visible position as viewed from the surface of said composite yarn, and subsequently reversing the process by submerging the other of said colored textured yarns within said composite yarn and surfacing said one of said colored textured yarns to a visible position in said composite yarn as viewed from the surface of said composite yarn, and again squeezing said colored textured yarns together with said wrapper yarn to preserve the resulting color separation along the length of said composite yarn.

2. The process defined in claim 1 wherein said lengthwise color difference of either the primary red, blue or green is 25% or more, from one length to an adjacent length along the length of said composite yarn.

3. The process defined in claim 1, wherein at least two said wrapper yarns are wrapped around said colored yarns, one in the S-direction and one in the Z-direction.

4. The process defined in claim 1, wherein said intermittent submerging and surfacing steps are performed by alternately tensioning one of said colored yarns while relaxing the other.

5. The process defined in claim 1 wherein each adjacent color length is between about 4 inches to 144 inches.

* * * * *